United States Patent [19]

Zott

[11] Patent Number: 4,713,932

[45] Date of Patent: Dec. 22, 1987

[54] SUPPORTING DISK FOR A SUPPORTING-DISK BEARING OF AN OPEN-END SPINNING MACHINE

[75] Inventor: Werner Zott, Donzdorf, Fed. Rep. of Germany

[73] Assignees: Fritz Stahlecker; Hans Stahlecker, both of Fed. Rep. of Germany

[21] Appl. No.: 38,139

[22] Filed: Apr. 14, 1987

[30] Foreign Application Priority Data

May 10, 1986 [DE] Fed. Rep. of Germany ..... 3615777

[51] Int. Cl.[4] ..... D01H 7/882; D01H 1/241

[52] U.S. Cl. ..... 57/406; 57/404

[58] Field of Search ..... 57/400, 404, 406, 92, 57/104

[56] References Cited

U.S. PATENT DOCUMENTS

| | | | |
|---|---|---|---|
| 3,779,620 | 12/1973 | Stahlecker | 57/406 X |
| 3,805,506 | 4/1974 | Stahlecker | 57/406 X |
| 3,938,312 | 2/1976 | Noguera | 57/406 X |
| 4,041,688 | 8/1977 | Stahlecker | 57/104 |
| 4,149,365 | 4/1979 | Kobayashi et al. | 57/406 X |
| 4,183,199 | 1/1980 | Schumann | 57/105 X |
| 4,667,464 | 5/1987 | Stahlecker et al. | 57/406 |

FOREIGN PATENT DOCUMENTS 8433579 3/1985 Fed. Rep. of Germany .

*Primary Examiner*—Donald Watkins
*Attorney, Agent, or Firm*—Barnes & Thornburg

[57] ABSTRACT

In the case of a supporting disk for a supporting disk bearing for a shaft of an open-end spinning rotor having a disk-shaped basic body made of metal that, on its circumference, is equipped with a ring made of plastic, the outer surface of which forms a smooth, uninterrupted essentially cylindrical running surface, it is provided that the inner surface of the ring has a profiling by means of which the thickness of the ring is reduced in the central area as compared to the edge areas.

15 Claims, 5 Drawing Figures

Fig. 1
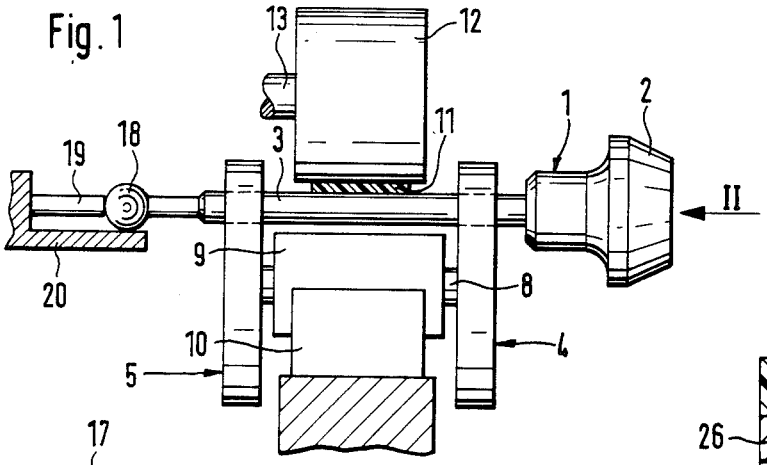
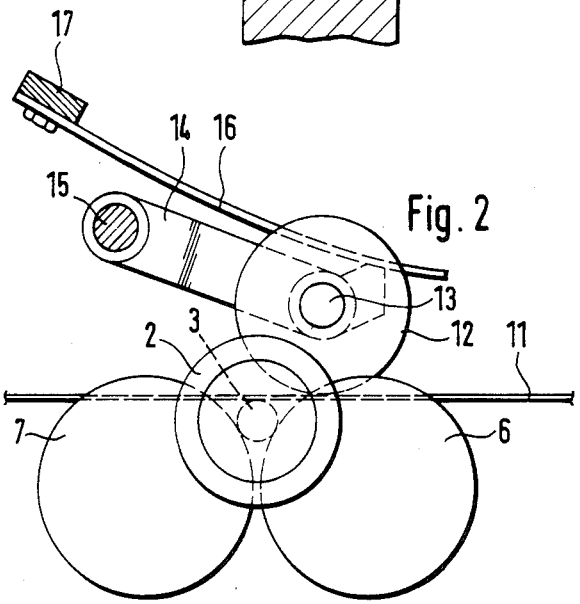
Fig. 2
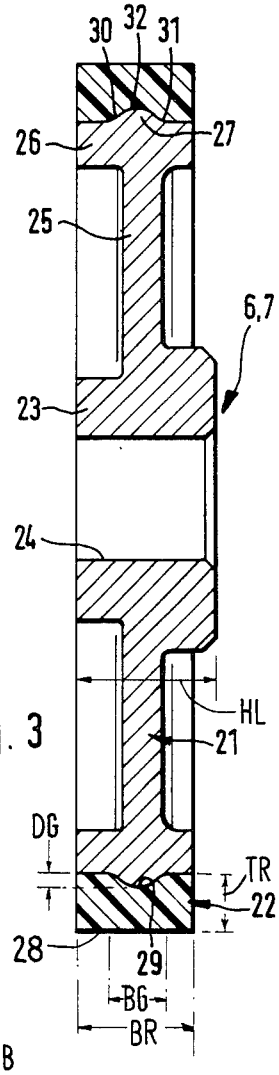
Fig. 3
Fig. 4
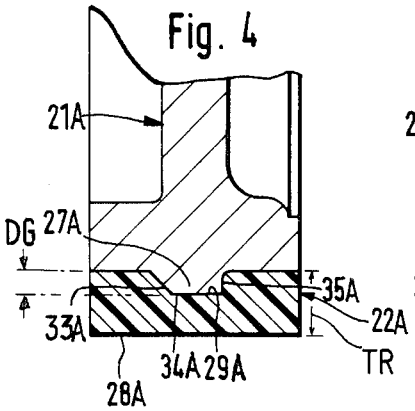
Fig. 5
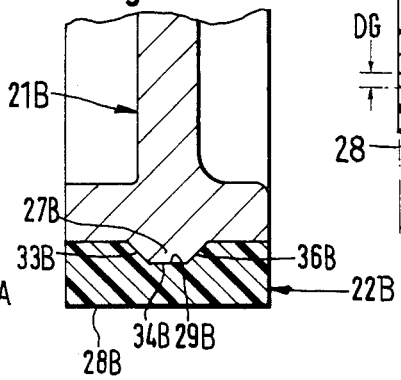

SUPPORTING DISK FOR A SUPPORTING-DISK BEARING OF AN OPEN-END SPINNING MACHINE

BACKGROUND AND SUMMARY OF THE INVENTION

The invention relates to a supporting disk for a supporting-disk bearing for a shaft of an open-end spinning rotor. The supporting disk has a disk-shaped basic body made of metal that is provided with a centric bore for receiving a shaft and that, on its circumference, has a ring made of plastic, said ring, with its outer surface, forming a smooth uninterrupted, essentially cylindrical running surface.

Supporting-disk bearings, such as those disclosed in U.S. Pat. No. 3,779,620, that are equipped with supporting disks of the initially mentioned type, have had excellent results in practice in the case of open-end spinning machines, because as a result it becomes possible to safely master very high rotating speeds of the spinning rotors. The supporting disks are subjected to a wear that is demonstrated by the fact that the rings made of plastic wear out over a period of time. Recent endeavors have aimed at increasing the rotating speeds of the spinning rotors even more, i.e., to above 100,000 $min^{-1}$ (revolution per minute). This results in a further increase of the wear of the rings made of plastic and in a shortening of their useful life. As tests have shown, this increased wear is essentially the result of the fact that the rings made of plastic are heated more than before due to the higher speeds.

In order to reduce the heating, it has become known (see German Utility Model - DE-GM No. 84 33 579) to provide a ring groove in the outer surface of the ring of plastic that serves as the running surface. By means of this ring groove, a cooling is to be achieved, particularly in the central area of the ring in which otherwise a heat buildup would occur and in which the damage to the ring would then start. It was found that by means of a ring groove of this type, a reduction of the heating is possible. However, certain disadvantages have to be accepted with such arrangements since, on the one hand, the production of the ring groove requires an additional machining or manufacturing process and, on the other hand, the ring groove reduces the effective support surface area of the running surface resulting in an increased strain to the ring and to the shaft of the open-end spinning rotor. Under certain circumstances, it is therefore necessary that the overall breadth of the ring in such arrangements be enlarged.

An objective of the present invention is to develop a supporting disk of the initially mentioned type in such a way that, also in the case of high stresses, an increased heating in the central area of the ring is avoided, while still maintaining the smooth and uninterrupted running surface.

This objective is achieved according to preferred embodiments of the invention by providing the inner surface of the ring with a profiling that reduces the thickness of the ring in the central area as compared to the edge areas.

The invention is based, at least in part, on the recognition that by merely reducing the thickness of the ring, an increased heating can be avoided in the central area, presumably because of the fact that then the flexing work in the central area is less and the heat dissipation is improved at the same time. The thicker edge areas that have a better heat dissipation anyhow and do not heat up as much provide nevertheless that a sufficient damping is achieved by means of the ring made of plastic.

In a further development of especially preferred embodiments of the invention, it is provided that the thickness of the ring in the central area is between $\frac{1}{3}$ to $\frac{1}{2}$ of the thickness of the ring in the edge areas. These dimensions well comply with the requirements of damping and an avoidance of the heating in the central area. For the same purpose, it is advantageous, in a further development of especially preferred embodiments of the invention, for the breadth of the area of the ring that was reduced in its thickness to be between 1/6 to $\frac{1}{3}$ of the overall breadth of the ring.

In a further advantageous development of preferred embodiments of the invention, it is provided that the circumferential surface of the basic body is provided with a counterprofiling that corresponds to the profiling of the inner surface of the ring so that the ring over its whole breadth connects to the circumferential surface of the basic body. This feature avoids the danger that, as a result of occurring centrifugal forces, the ring in its central area detaches itself from the basic body. In addition, the counterprofiling of the basic body results in an enlargement of the adhesion surface between the ring and the basic body so that on the whole an improved fastening is achieved.

In the case of certain preferred practical embodiments of the invention, it is provided that the inner surface of the ring is equipped with a surrounding ring groove. In a corresponding way, the circumferential surface of the basic body is equipped with a surrounding rib. In order to avoid that, during the operation, the ring is stressed excessively in the area of the reduced thickness, it is provided in an advantageous development that the bottom of the profiling extends at least approximately in parallel to the outer surface of the ring.

In a further development of certain preferred embodiments of the invention, it is provided that the basic body is made as an extruded part, preferably of an aluminum alloy. In this way the production of the basic body is cost-effective. In an advantageous further development, it is also provided that the ring is shaped onto the basic body by means of a centrifugal casting process. This results in an intimate connection between the basic body and the ring.

Other objects, advantages and novel features of the present invention will become apparent from the following detailed description of the invention when considered in conjunction with the accompanying drawings.

BRIEF DESCRIPTION OF THE DRAWINGS

FIG. 1 is a partial schematic view of a spinning station showing a simplified representation of a supporting-disk bearing of an open-end spinning rotor having four supporting disks of the type contemplated by the present invention;

FIG. 2 is a schematic view taken in the direction of the Arrow II of FIG. 1;

FIG. 3 is an enlarged sectional view of a supporting disk constructed according to a first preferred embodiment of the invention;

FIG. 4 is a partially enlarged sectional view of a supporting disk constructed according to a second preferred embodiment of the invention; and FIG. 5 is a partially enlarged sectional view of a supporting disk constructed according to a third preferred embodiment of the invention.

DETAILED DESCRIPTION OF THE DRAWINGS

In the drawings only those portions of an open-end rotor spinning machine are illustrated that are needed for one skilled in the art to understand, make and use the invention. It will be understood by those skilled in the art that the invention can be utilized in open-end rotor spinning machines of the type commercially available through the company W. Schlafhorst & Co. of Manchengladbach, West Germany. The bearing for supporting the spinning rotor shaft in this Schlafhorst machine uses a so-called Suessen twin disk bearing. Such commercial machines have a plurality of adjacent commonly driven spinning stations, the type depicted in FIGS. 1 and 2.

In the case of the supporting-disk bearing according to FIG. 1 and 2, an open-end spinning rotor 1, that has a rotor or rotor cup 2 and a shaft 3, is disposed in a supporting-disk bearing. The shaft 3 of the open-end spinning rotor 1 is disposed in the wedge-shaped gaps of two paris 4, 5 of supporting rollers that each include of supporting disks 6, 7. The supporting disks 6, 7 are arranged in a torsionally fixed way on shafts 8 that are disposed in a bearing housing 9 that is held in a stationary holding means 10.

The shaft 3 of the open-end spinning rotor 1 is driven by means of a tangential belt 11, that passes through in the longitudinal direction of an open-end spinning machine. The tangential belt 11 is loaded in the direction of the shaft 3 by means of a tension roller 12. The tension roller 12, with its shaft 13, is pivoted in a lever 14 that can be swivelled around a stationary shaft 15 and is loaded by a leaf spring 16. The leaf spring 16 is clamped into a stationary holding means 17.

The shafts 8 of the supporting disks 6, 7 have a slightly diagonal position with respect to a central axis extending in parallel to the tangential belt 11, so that an axial thrust is generated, by means of which the end of the shaft 3 supports itself against a step bearing ball 18. The step bearing ball 18, on the side that is opposite the shaft 3, is supported by a bolt 19 that can vibrate and is arranged in a stationary holding means 20.

The supporting disks 6, 7 constructed according to a first preferred embodiment of the invention illustrated in FIG. 3 each comprise a basic body 21 made of metal that is provided with a centric bore 24 for receiving the shaft 8. The bore 24 is located in the area of a hub 23 that has a cylindrical outer contour for accommodating clamping of the basic body 21 during manufacture. A disk-shaped web 25 is connected to this hub 23 which web 25 carries an annular ring projection 26. The breadth BR of ring projection 26 is slightly smaller in axial direction than the axial length HL of the hub 23.

A ring 22 made of plastic is mounted on the circumference of the basic body 21. Ring 22 has a smooth cylindrical outer surface 28 that forms a running surface for the shaft 3 of the open-end spinning rotor 1.

The basic body 21 is manufactured as a extruded part made of an aluminum - magnesium - silicon alloy. The ring 22 is made of plastic and is formed directly onto the basic body 21 in a centrifugal casting process. The ring 22 consists of a rubber-type plastic that has a hardness of a magnitude of 50 shore D. The outer surface 28 of the ring 22 that serves as the running surface is machined by turning, which advantageously takes place while the hub 23 of the basic body 21 is still clamped in place for the centrifugal casting process. Generally, a subsequent grinding of the outer surface 28 is not necessary.

In order to ensure the requirement of a good damping of the spinning rotor 1 disposed in the paris 4, 5 of supporting disks on the rings 22, a thickness TR is provided in radial direction for the ring 22 that amounts to between 3 mm and 6 mm. In especially preferred embodiments for use with very high rotating speeds, the thickness TR of the ring is 4 mm. In order to avoid an unfavorable heating of the ring 22, particularly in the central area, it is provided that the thickness of the ring 22 is reduced in the central area, in which case, however, the smooth, uninterrupted outer surface 28 is retained. The ring 22 is therefore provided in its central area on its interior surface with a profiling that in the case of the shown embodiments, is developed as a surrounding ring groove 29. The depth DG of the ring groove 29, in preferred practical embodiments is between 1 mm to 2 mm, which corresponds to between $\frac{1}{3}$ to $\frac{1}{2}$ of the thickness TR of the ring 22 in the end areas. The breadth BR of the ring groove 29 amounts to about 1/6 to $\frac{1}{3}$ of the overall breadth BR of the ring that, in the practical embodiments has an overall breadth of 10 mm to 14 mm. The basic body 21, in the shown embodiments, is provided with a counter profiling that corresponds to the profiling of the ring 22; i.e., in the case of the illustrated embodiment of FIG. 3, with a surrounding rib 27.

In the case of the embodiment according to FIG. 3, the surrounding rib 27 and the ring groove 29 in each case exhibit three radiuses 30, 32, 31 that are placed in a row with respect to one another. The area of the central radius 32, in its vertex area, forms a surface that extends essentially in parallel to the outer surface 28 of the ring 22. Because the ring 22 is shaped onto the basic body 21 by means of centrifugal casting, the rib 27 and the ring groove 29 have the same radiuses 30, 32 and 31.

In the case of the embodiment according to FIG. 4 where corresponding structure as in FIG. 3 is depicted by the same reference characters with the suffix "A", the ring 22A is provided with a ring groove 29A that is asymmetrical with respect to the longitudinal central plane. The ring groove 29A has a bottom 34A that extends in parallel with respect to the outer surface 28A, a sloped lateral wall 33A being connected to said bottom 34A on one side, and a radial lateral wall 35A being connected to it on the other side. The basic body 21A has a correspondingly profiled rib 27A.

In the case of the embodiment according to FIG. 5 where corresponding structures as in FIG. 3 are depicted by the same reference characters with the suffix "B", the ring 22B is provided with a ring groove 29B that has a flat bottom 34B extending in parallel with respect to the outer surface 28B, two sloped lateral walls 33B and 36B resting laterally against said bottom 34B. The rib 27B of the basic body 21B has a corresponding profiling.

According to the invention, it was found that by means of the reduction of the thickness of the ring 22, 22A, 22B because of the ring groove 29, 29A, 29B on the one hand an inadmissible heating in the central area can be avoided, while the damping capacity of the ring 22, 22A, 22B is not significantly adversely affected.

Although the present invention has been described and illustrated in detail, it is to be clearly understood that the same is by way of illustration and example only, and is not to be taken by way of limitation.

What is claimed:

1. A supporting disk for a supporting-disk bearing for a shaft of an open-end spinning rotor, comprising:

a disk-shaped basic body made of rigid material and provided with a centric bore for receiving a shaft; and a ring circumferentially surrounding and fitted to the basic body, said ring, forming a smooth uninterrupted, essentially cylindrical running outer surface for supporting a rotor shaft, said ring being formed of ring material other than the material of the basic body and serving to provide damping support to a rotor shaft.

wherein an inner surface of the ring has a profiling by means of which the thickness of the ring in its central area is reduced with respect to its edge areas.

2. A supporting disk according to claim 1, wherein the thickness of the ring in the central area amounts to between $\frac{1}{3}$ to $\frac{1}{2}$ of the thickness of the ring in the edge areas.

3. A supporting disk according to claim 1, wherein the ring in the central area is between 2 mm to 5 mm thick.

4. A supporting disk according to claim 1, wherein the breadth of the area of the ring that is reduced in its thickness amounts to between 1/6 to $\frac{1}{3}$ of the overall breadth of the ring.

5. A supporting disk according to claim 1, wherein the circumferential surface of the basic body is provided with a counterprofiling that corresponds to the profiling of the inner surface of the ring, so that the ring, over its whole breadth, connects to the circumferential surface of the basic body.

6. A supporting disk according to claim 1, wherein the inner surface of the ring is provided with a surrounding ring groove as the profiling.

7. A supporting disk according to claim 6, wherein the circumferential surface of the basic body is provided with a surrounding rib.

8. A supporting disk according to claim 1, wherein the bottom of the profiling extends at least approximately in parallel to the outer surface of the ring.

9. A supporting disk according to claim 1, wherein the basic body is produced as an pressed part that is preferably made of an aluminum alloy.

10. A supporting disk according to claim 1, wherein the ring is shaped onto the basic body that has a counterprofiling on its circumferential surface.

11. A supporting disk according to claim 10, wherein the ring is shaped onto the basic body by means of a centrifugal casting process.

12. A supporting disk according to claim 1, wherein the basic body is made of metal and the ring is made of plastic.

13. A supporting disk according to claim 12, wherein the thickness of the ring in the central area amounts to between $\frac{1}{3}$ to $\frac{1}{2}$ of the thickness of the ring in the edge areas.

14. A supporting disk according to claim 13, wherein the ring in the central area is between 2 mm to 5 mm thick.

15. A supporting disk according to claim 14, wherein the breadth of the area of the ring that is reduced in its thickness amounts to between 1/6 to $\frac{1}{3}$ of the overall breadth of the ring.

* * * * *